US005823825A

United States Patent [19]

Murphy

[11] Patent Number: 5,823,825

[45] Date of Patent: Oct. 20, 1998

[54] SYSTEM FOR TERMINATING THE SHIELD OF A HIGH SPEED CABLE

[75] Inventor: Paul Murphy, Naperville, Ill.

[73] Assignee: Molex Incorporated, Lisle, Ill.

[21] Appl. No.: 944,718

[22] Filed: Oct. 6, 1997

Related U.S. Application Data

[63] Continuation of Ser. No. 609,307, Mar. 1, 1996.

[51] Int. Cl.[6] ..... H01R 9/03

[52] U.S. Cl. ..... 439/610

[58] Field of Search ..... 439/607, 608, 439/609, 610, 585, 877, 880

[56] References Cited

U.S. PATENT DOCUMENTS

| | | | |
|---|---|---|---|
| 4,615,578 | 10/1986 | Stadler et al. | 439/607 |
| 4,813,888 | 3/1989 | Tokizane et al. | 429/583 |
| 5,061,827 | 10/1991 | Grabbe | 174/756 |
| 5,073,128 | 12/1991 | Sirai et al. | 439/585 |
| 5,114,366 | 5/1992 | Sato | 439/585 |
| 5,120,241 | 6/1992 | Sirai et al. | 439/585 |
| 5,120,259 | 6/1992 | Nakata et al. | 439/585 |
| 5,145,409 | 9/1992 | Sato et al. | 439/585 |
| 5,197,893 | 3/1993 | Morlion et al. | 439/101 |
| 5,304,069 | 4/1994 | Brunker et al. | 439/108 |
| 5,509,827 | 4/1996 | Huppenthal et al. | 439/638 |

FOREIGN PATENT DOCUMENTS

| | | |
|---|---|---|
| 0 385 020 B1 | 7/1996 | European Pat. Off. . |
| 2 718 299 | 10/1995 | France . |

*Primary Examiner*—Gary F. Paumen
*Assistant Examiner*—Yong Ki Kim
*Attorney, Agent, or Firm*—Charles S. Cohen

[57] ABSTRACT

A terminal is disclosed for terminating the shields of a plurality of high speed cables each having an outer jacket and an inner metallic shield with a portion of the outer jacket removed to expose a portion of the metallic shield. The terminal includes a conductive ground plate portion. A gripping arm projects from the ground plate portion for embracing all of the plurality of high speed cables in direct engagement with the exposed portions of the metallic shields thereat. A solder connection is disposed between the gripping arm and the metallic shields.

21 Claims, 4 Drawing Sheets

SYSTEM FOR TERMINATING THE SHIELD OF A HIGH SPEED CABLE

CROSS REFERENCE TO RELATED APPLICATION

This application is a continuation application of U.S. patent application Ser. No. 08/609,307, filed Mar. 1, 1996, entitled "SYSTEM FOR TERMINATING THE SHIELD OF A HIGH SPEED CABLE", which prior application is assigned to the same assignee as the assignee of the present application.

FIELD OF THE INVENTION

This invention generally relates to the art of electrical connectors and, particularly, to a system for terminating the metallic shield of a high speed cable, such as the metallic braid of the cable.

BACKGROUND OF THE INVENTION

A typical high speed cable includes a center conductor or core surrounded by a tube-like inner dielectric. A shield is disposed outside the inner dielectric for shielding and/or grounding the cable. The shield typically is a tubular metallic braid. However, one or more longitudinal conductive wires have also been used and are commonly called "drain wires." An insulating jacket surrounds the composite cable outside the shield.

Various types of connectors are used to terminate high speed cables. The connectors typically have contacts which are terminated to the center conductor or core of the cable. The connectors also have one form or another of a terminating member for terminating the metallic shield of the high speed cable, usually for grounding purposes. A typical system in such connectors terminates the metallic shield to the terminating member by soldering. Other systems use crimping procedures to crimp at least a portion of the terminating member securely to the metallic braid for commoning purposes.

With the ever-increasing miniaturization of the electronics in various industries, such as in the computer and telecommunications industries, along with the accompanying miniaturization of electrical connectors, considerable problems have been encountered in terminating miniature high speed cables, particularly in terminating the metallic shield of the cable. For instance, the outside diameter of a small coaxial cable may be on the order of 0.090 inch. The outside diameter of the inner dielectric surrounding the conductor/core may be on the order of 0.051 inch, and the diameter of the center conductor/core may be on the order 0.012 inch. Coaxial cables having even smaller dimensional parameters have been used.

The problems in terminating such very small coaxial cables often revolve around terminating the metallic shield of the cable. For instance, if soldering methods are used, applying heat (necessary for soldering) in direct proximity to the metallic shield can cause heat damage to the underlying inner dielectric and, in fact, substantially disintegrate or degrade the inner dielectric. If conventional crimp-type terminations are used, typical crimping forces often will crush or deform the inner dielectric surrounding the center conductor/core of the cable.

The above problems are further complicated when the metallic shield of the high speed cable is not terminated to a cylindrical terminating member, but the shield is terminated to a flat terminating member or contact. For instance, it is known to terminate the tubular metallic shield or braid of a coaxial cable to a flat ground circuit pad on a printed circuit board. This is accomplished most often by simply gathering the tubular metallic braid of the coaxial cable into a twisted strand or "pigtail" which, in turn, is soldered to the flat ground pad on the circuit board.

Another example of terminating the metallic shield or braid of a coaxial cable to a flat ground member is shown in U.S. Pat. No. 5,304,069, dated Apr. 19, 1994 and assigned to the assignee of the present invention. In that patent, the metallic braids of a plurality of coaxial cables are terminated to a ground plate of a high speed signal transmission terminal module. The conductors/cores of the coaxial cables are terminated to signal terminals of the module.

In terminating the tubular metallic shields or braids of high speed cables to flat ground contact pads as in a printed circuit board, or to a planar ground plate as in the above-referenced U.S. patent, or to any other flat or non-tubular terminating member, various design considerations should be considered as has been found with the present invention. It should be understood that there is a transition zone created where the center conductor/core of the high speed cable goes from a "controlled environment" wherein the conductor/core is completely surrounded by the tubular metallic shield or braid, to an "uncontrolled environment" where the braid is spread away from the conductor/core for termination to the non-tubular terminating member. It is desirable that this transition zone be held to as small an area as possible and as short a length (i.e., longitudinally of the cable) as possible. Preferably, the metallic shield or braid should be terminated over an area (or at least at two points) approximately 180° apart in relation to the center conductor/core of the cable. Preferably, the flat terminating member should overlap or at least extend to the point where the metallic shield or braid is separated from its tubular configuration surrounding the conductor/core of the cable. Still further, it is desirable that the metallic shield or braid of any given high speed cable be terminated on the same side of the flat terminating member as the center conductor/core of the cable.

The present invention is directed to solving the above-identified problems and satisfying as many of the above-identified design parameters as possible in an improved system for terminating the metallic shield of a high speed cable to a terminating member, such as a ground plate.

SUMMARY OF THE INVENTION

An object, therefore, of the invention is to provide a new and improved system or terminal for terminating the metallic shields of a plurality of high speed cables.

In the exemplary embodiment of the invention, a terminal is disclosed for terminating the shields of a plurality of high speed cables each having an outer jacket and an inner metallic shield with a portion of the outer jacket removed to expose a portion of the metallic shield. The terminal includes a conductive ground plate portion. A gripping arm projects from the ground plate portion for embracing the plurality of high speed cables in direct engagement with the exposed portions of the metallic shields thereof. A solder connection is disposed between the gripping arm and the metallic shields.

As disclosed herein, the ground plate is generally planar, and the gripping arm projects inwardly from an edge of the ground plate. Preferably, a pair of the gripping arms project from opposite sides of the ground plate, with the gripping arms projecting inwardly from opposite edges of the ground plate. In the preferred embodiment, each gripping arm is contoured to cooperate with the ground plate to define discrete chambers for respectively receiving the plurality of high speed cables. Specifically, each gripping arm is undulated to define generally semi-cylindrical portions for respectively embracing the plurality of high speed cables.

In one embodiment of the invention, each gripping arm includes an opening for receiving the solder connection therethrough. In the preferred embodiment, the opening is a circumferentially extending slot. The slot is on the order of 0.040 inch wide. In another embodiment, the solder connection is disposed on the inside of the gripping arms by solder material having been deposited thereat and subsequently reflowed. Preferably, the solder material is deposited as an inlay on the inside of the gripping arms.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
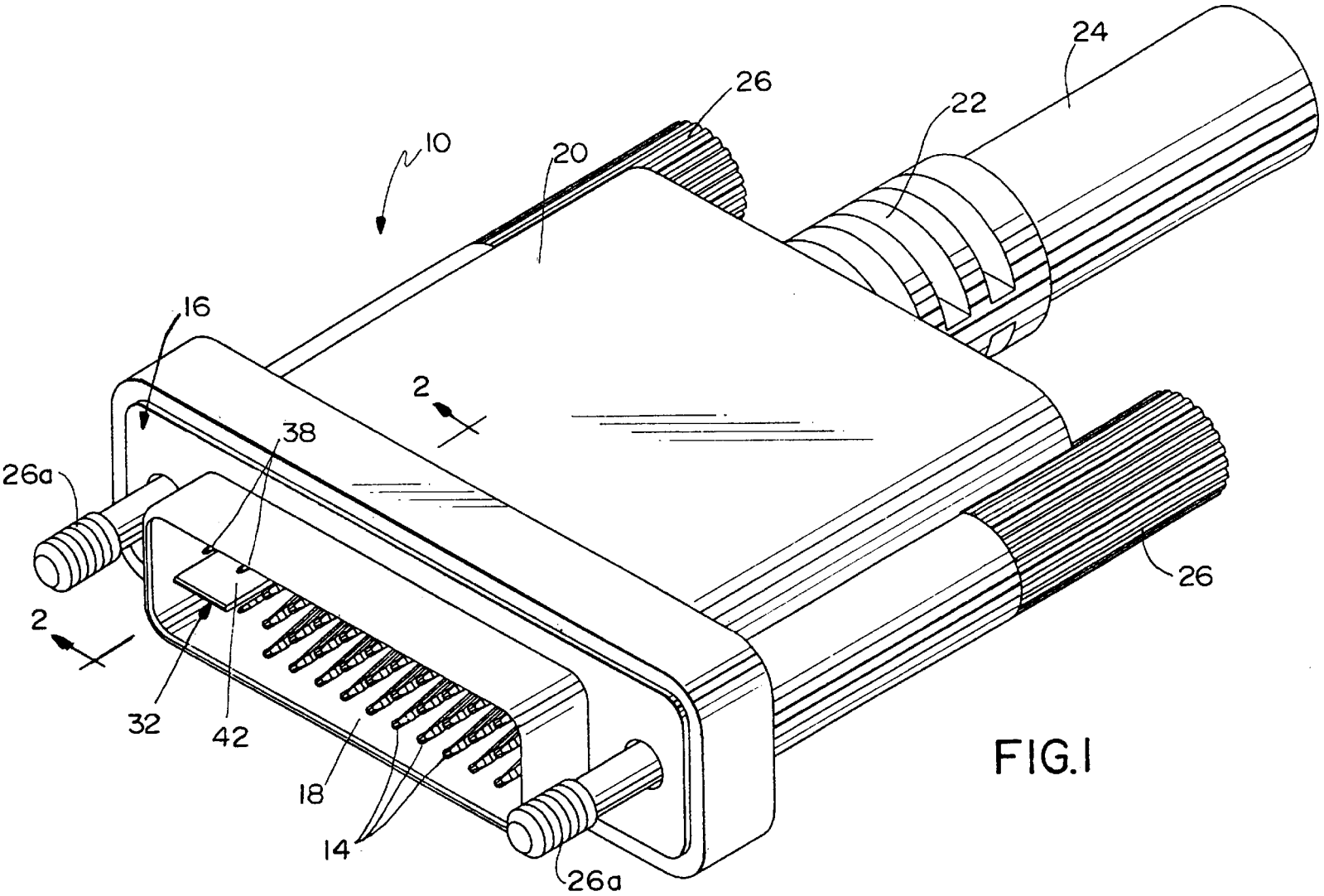
FIG. 1 is a perspective view of an electrical connector of a type in which the invention is applicable.
Figure 2:
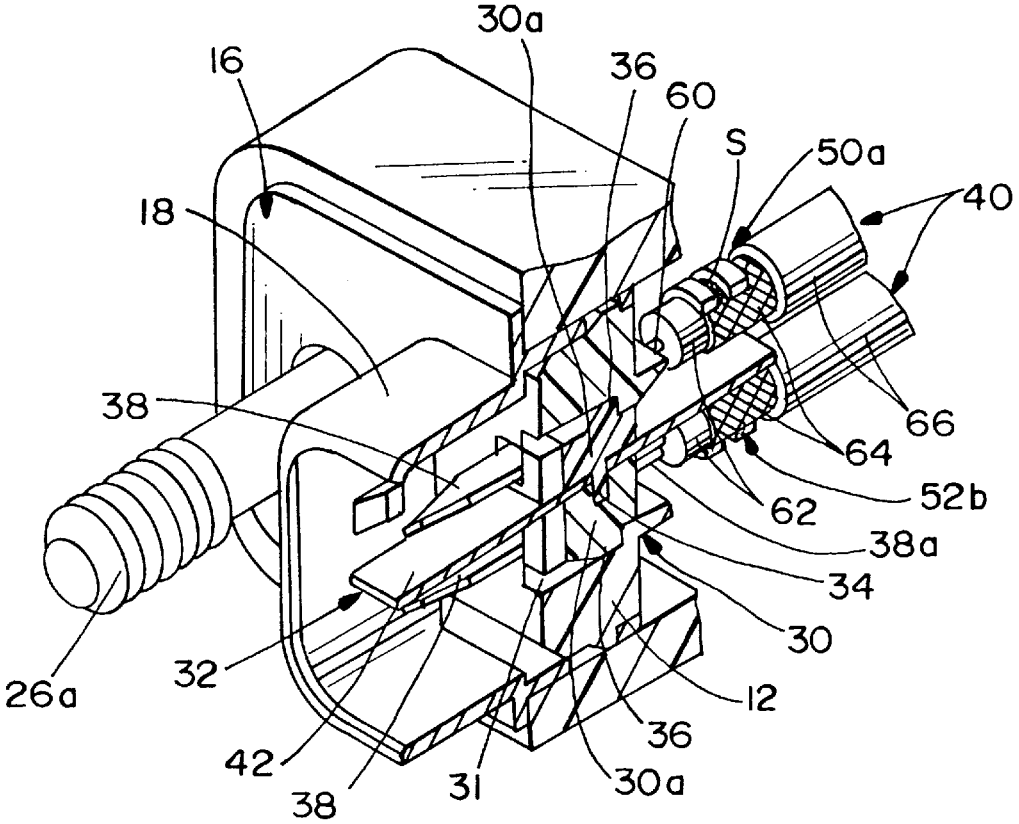
FIG. 2 is a fragmented vertical section taken generally along line 2—2 of FIG. 1.

Referring to the drawings in greater detail, and first to FIGS. 1 and 2, the invention is embodied in a shielded electrical connector, generally designated 10, which is a hybrid electrical connector for terminating both the conductors of slower data transmission lines and the conductors of high speed or high frequency transmission lines. In particular, electrical connector 10 includes a dielectric housing 12 (FIG. 2) mounting a plurality of data transmission terminals 14 (FIG. 1). A conductive shield, generally designated 16, substantially surrounds dielectric housing 12 and has a shroud portion 18 projecting forwardly about the mating ends of data transmission terminals 14. A two-piece backshell (not shown) substantially in conformance with that shown in U.S. Pat. No. 5,358,428, dated Oct. 25, 1994, projects rearwardly of housing 12 and shield 16. An overmolded boot 20 includes an integral cable strain-relief 22 that is in engagement with a composite electrical cable 24 which includes both the data transmission lines and the high speed or high frequency transmission lines. A pair of thumb screws 26 project through the overmolded boot and include externally threaded forward distal ends 26*a* for securing the connector to a complementary mating connector, panel or other structure.

As seen best in FIG. 2, a high speed signal transmission terminal module, generally designated 30, is inserted into a passage 31 in dielectric housing 12 from the rear thereof. The terminal module includes a pair of identical terminal blocks 30*a* and 30*b* which clamp a ground plate, generally designated 32, therebetween. Each terminal block includes a post 34 and a recess. The post from each terminal block extends from each terminal block through a hole or slot 44 (FIG. 3) in the ground plate and into a recess in the other terminal block to secure terminal blocks 30*a* and 30*b* to ground plate 32 as a subassembly. Once this subassembly is inserted into passage 31 in housing 12 as shown in FIG. 2, the terminal blocks are effective to clamp the ground plate therebetween. The terminal module is held within the dielectric housing by ramped latches 36 on each terminal block.

Each terminal block 30*a* and 30*b* is overmolded about at least one high speed signal terminal 38. The contact ends of a pair of the terminals 38, along with the forward end of ground plate 32, are shown projecting forwardly of the connector in FIG. 1, within the surrounding shroud portion 18 of shield 16. The rear ends 38*a* of terminals 38 (FIG. 7) are terminated to the center conductor/cores 60 of a plurality of coaxial cables, generally designated 40 in FIG. 2. The invention is particularly directed to the manner of termination of the metallic shields of the coaxial cables to ground plate 32, as described below.

Figure 3:
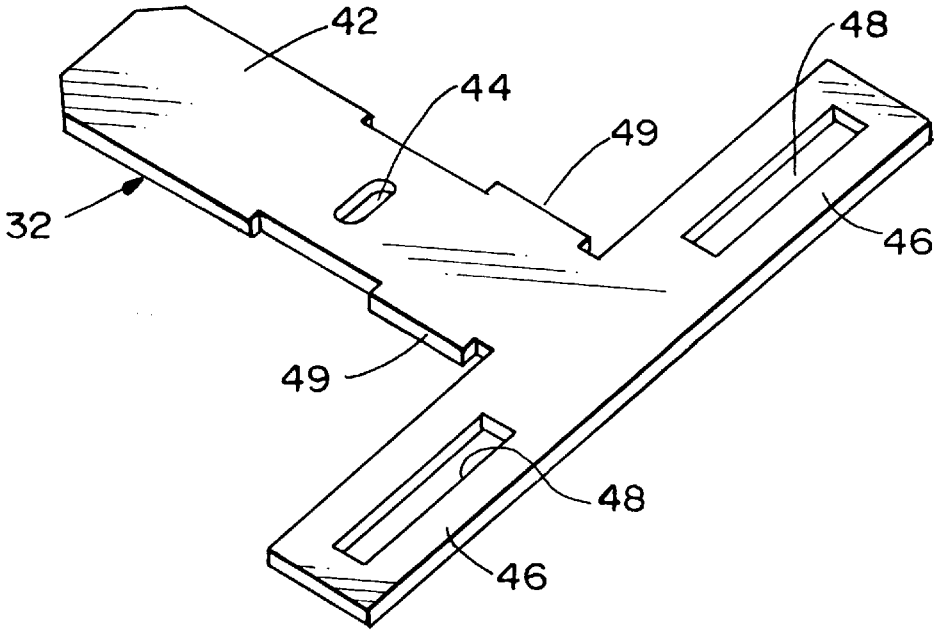
FIG. 3 is a plan view of a stamped metal blank from which the terminal or ground plate is formed.

More particularly, FIG. 3 shows a blank, generally designated "B," stamped from conductive sheet metal material and from which ground plate 32 is formed. Blank "B" is generally T-shaped and includes a leg or stem portion 42 which will form a blade portion for ground plate 32. The blade portion includes aperture 44 through which posts 34 (FIG. 2) of terminal blocks 30*a* and 30*b* extend. A wing or arm 46 projects outwardly at one end of leg 42 generally at each opposite edge thereof. These wings will form the gripping arms of the ground plate, as will be seen hereinafter. Each wing or gripping arm has an elongated slot 48 to facilitate the solder termination described hereinafter.

When soldering cable shields 56 to ground plate 32, it is desirable to use a soldering iron having a relatively small tip. Although it is desirable to dimension the slot wide enough to facilitate adequate solder flow throughout the slot, it should be narrow enough to prevent the relatively small tip of the soldering iron from contacting the braid or shield 56 of the cable, which could result in damage to the underlying inner dielectric 62. Each slot is on the order of approximately 0.040 inch wide, although it is believed that such slot could be within the range of 0.010 to 0.110 inch wide. Finally, barbs or teeth 49 are stamped at the opposite edges of blade portion 42 to facilitate holding the subassembly of the ground plate and terminal blocks 30*a* and 30*b* within the housing.

As will be seen hereinafter, once formed, ground plate 32 is provided with a positioning and gripping arm on each side of the ground plate for positioning and gripping a pair of coaxial cables. The arms are located at the extreme rear distal end of blade portion 42. With this structure, the ground plate can terminate from one to four coaxial cables depending on the specifications of the connector. In some computer applications, three cables may be used to carry the red, green and blue chroma signals for a monitor. A fourth cable might be used for flat screen monitors for carrying the pixel clock timing signals.

Figure 4:
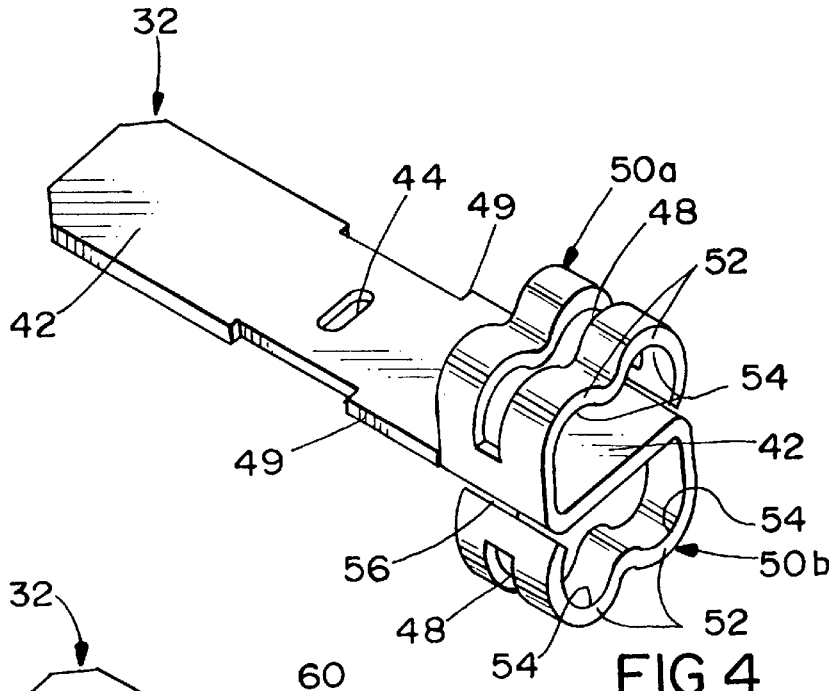
FIG. 4 is a perspective view of the ground plate with the gripping arms formed to receive the coaxial cables.

FIG. 4 shows the stamped blank "B" of FIG. 3 with wings 46 having been bent inwardly to form an upper positioning and gripping arm, generally designated 50*a*, and a lower positioning and gripping arm, generally designated 50*b*. Each gripping arm is contoured in an undulated configuration to define a pair of semi-cylindrical portions 52 which cooperate with blade portion 42 to define discrete chambers 54 for receiving a plurality of coaxial cables, as described hereinafter. It can be seen that, after forming, slots 48 in the arms extend in a circumferential direction about portions of each chamber 54. It also can be seen that each gripping arm extends entirely across blade portion 42, leaving only a very small gap 56 between the distal end of the arm and the blade portion. Therefore, the coaxial cables are substantially entirely surrounded by the gripping arms and the blade portions. With this structure, the ground plate can terminate from one to four coaxial cables depending on the specifications of the connector.

Figure 5:
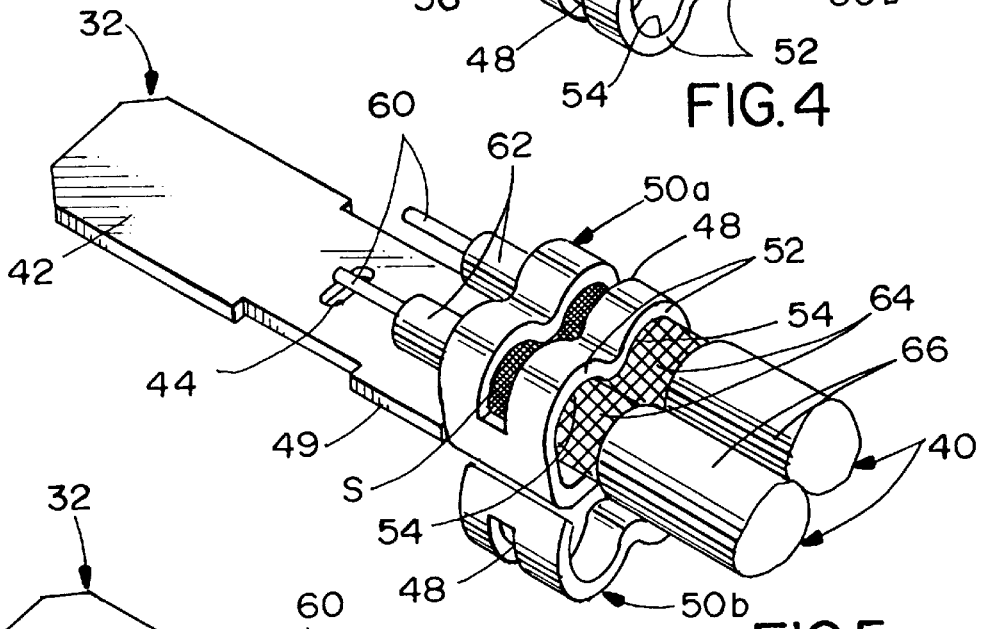
FIG. 5 is a perspective view of the formed ground plate with a pair of coaxial cables positioned therein, and with the cables prepared by removing portions of the outer jackets to expose the metallic shields.

FIG. 5 shows the formed ground plate 32 of FIG. 4 with a pair of coaxial cables 40 positioned within chambers 54 of upper gripping arm 50*a*. At this point, it should be understood that each coaxial cable 40 is of a conventional construction in that each cable includes a center conductor or core 60 surrounded by a tube-like inner dielectric 62. A metallic shield in the form of a tubular metallic braid 64 surrounds inner dielectric 62. An insulating jacket 66, as of plastic or the like, surrounds metallic braid 64 to form the overall composite coaxial cable 40.

Figure 7:
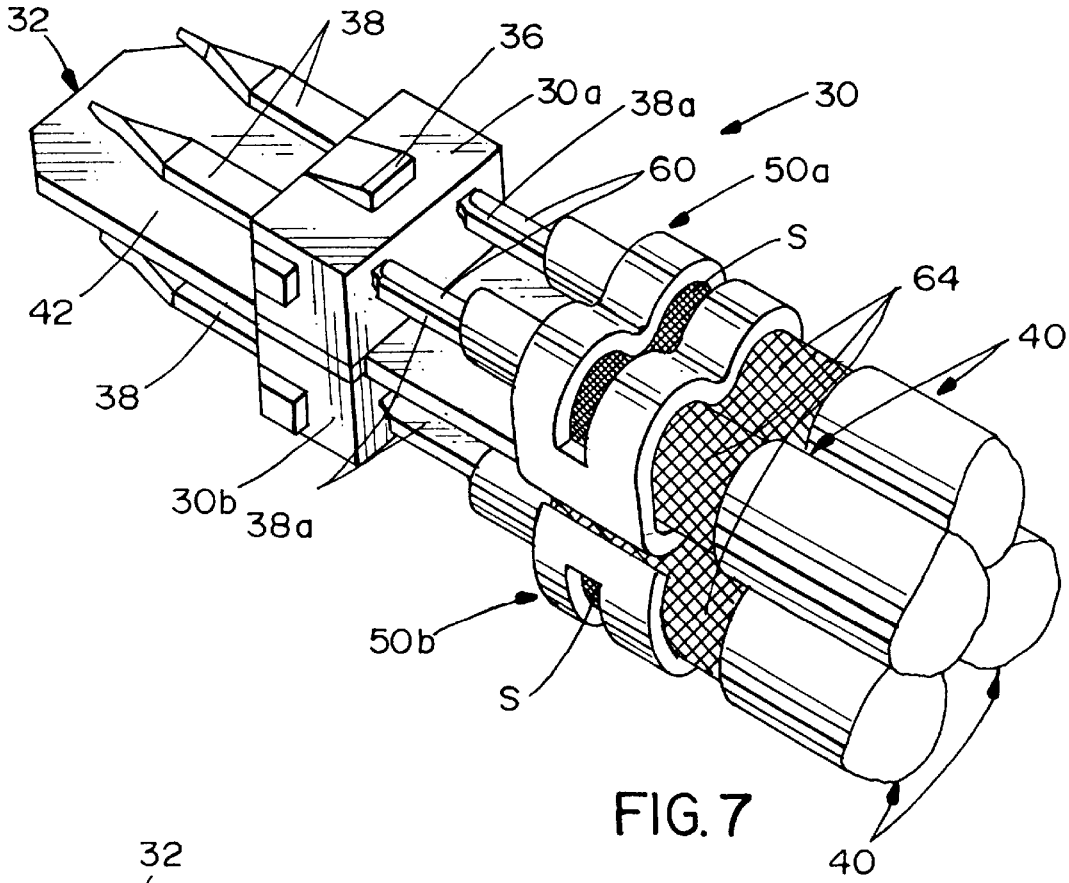
FIG. 7 is a perspective view of the terminal module mountable in the connector of FIGS. 1 and 2.

FIG. 5 also shows that center conductor/core 60 of each coaxial cable 40 has been stripped to expose a given length thereof which will be soldered to the inner end of one of the high speed signal transmission terminals 38 (FIG. 7). The outer insulating jacket 66 of each cable also has been cut-back to expose a given length of the respective metallic shield 64. Therefore, the exposed shields can be soldered to the gripping arms 50*a* or 50*b* of ground plate 32 as discussed below.

As stated, FIG. 5 shows gripping arms 50*a* and 50*b* in position for receiving coaxial cables 40 prepared as described above. FIG. 5 shows two coaxial cables 40 positioned within upper gripping arm 50*a* longitudinally so that metallic shields 64 of the cables are in registry with the gripping arm on the inside thereof. Each coaxial cable is positioned longitudinally within one of the chambers 54 defined by semi-cylindrical portions 52. The coaxial cables may be positioned within the gripping arm by a slight press-fit. Alternatively, the gripping arms may be initially formed to freely receive the coaxial cables longitudinally thereinto, whereas the arms initially function only to position the cables, and, thereafter, the arms may be further formed to positively grip the coaxial cables and completely close gaps 56. In such embodiment, the free end of gripping arms 50*a* and 50*b* could include some type of latch (not shown) to engage or overlap a portion of ground plate 32 or the other gripping arm in order to completely encircle the coaxial cable. It should be understood that the gripping arms are not crimped onto the metallic shields as is typical in the crimping art. Rather, an amount of force is used to slightly form the gripping arms inwardly, so as only to grip and retain the coaxial cables prior to soldering. The gripping or crimping pressure should not be excessive so as to damage the underlying inner dielectric material 62 to any extent, which could affect the electrical performance thereof.

Ground plate 32 then is mechanically and electrically connected to metallic shields 64 of the coaxial cables by soldering the metallic shields to gripping arm 50*a* by applying solder through slot 48 in the gripping arm, as at "S" in FIG. 5. As stated above, the slots are formed on the order of approximately 0.040 inch wide to prevent the application of concentrated heat directly to the metallic shield, which could cause heat damage to the underlying inner dielectric. The slot should be sufficiently narrow to at least prevent whatever soldering iron or tool is used from passing through the slot and into direct engagement with the metallic shield. Such engagement may result in damage to the underlying inner dielectric. In essence, the slots restrict the amount of soldering heat which is transmitted inwardly to the inner dielectric. On the other hand, the slots extend in a circumferential direction to provide a large circumferential area of access to the metallic shields in a circumferential direction.

Figure 6:
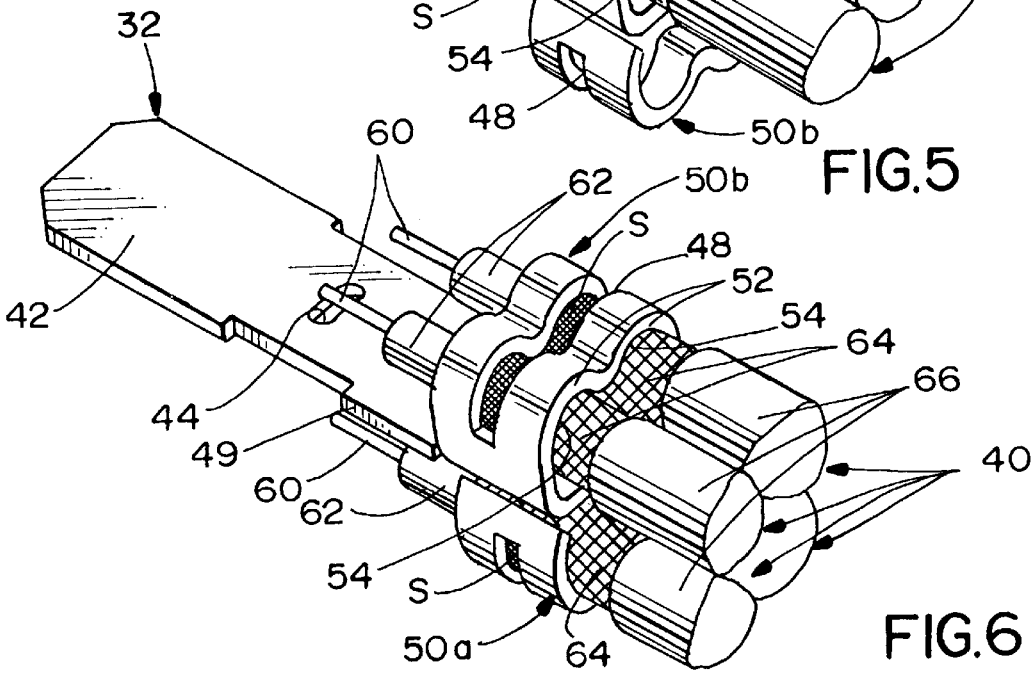
FIG. 6 is a view similar to that of FIG. 5, but showing four coaxial cables positioned in the ground plate.

Once the two coaxial cables 40 are soldered to the upper gripping arm 50*a* as shown in FIG. 5, ground plate 32 is inverted as shown in FIG. 6 and another pair of coaxial cables are inserted into chambers 54 of the other gripping arm 50*b* and soldered thereto as described above in relation to FIG. 5.

Once the subassembly of FIG. 6 is fabricated, including the soldering procedures, this subassembly is assembled to terminal blocks 30*a* and 30*b* including high speed signal transmission terminals 38 to form terminal module 30 as shown in FIG. 7 and described above in relation to FIG. 2. Center conductors/cores 60 of the coaxial cables are then connected, as by soldering, welding or otherwise securing to the inner ends 38*a* of terminals 38, while terminal blocks 30*a* and 30*b* clamp blade portion 42 of ground plate 32 therebetween, as shown in FIG. 2 and described above. The terminal module then is mounted within dielectric housing 12 as shown in FIG. 2. If desired, terminal blocks 30*a* and 30*b* could be mounted to blade portion 42 of ground plate 32 prior to inserting cables 40 into gripping arms 50*a* and 50*b*. In other words, the ground plate would have the terminal blocks mounted thereon at the beginning of the termination process.

Figure 8:
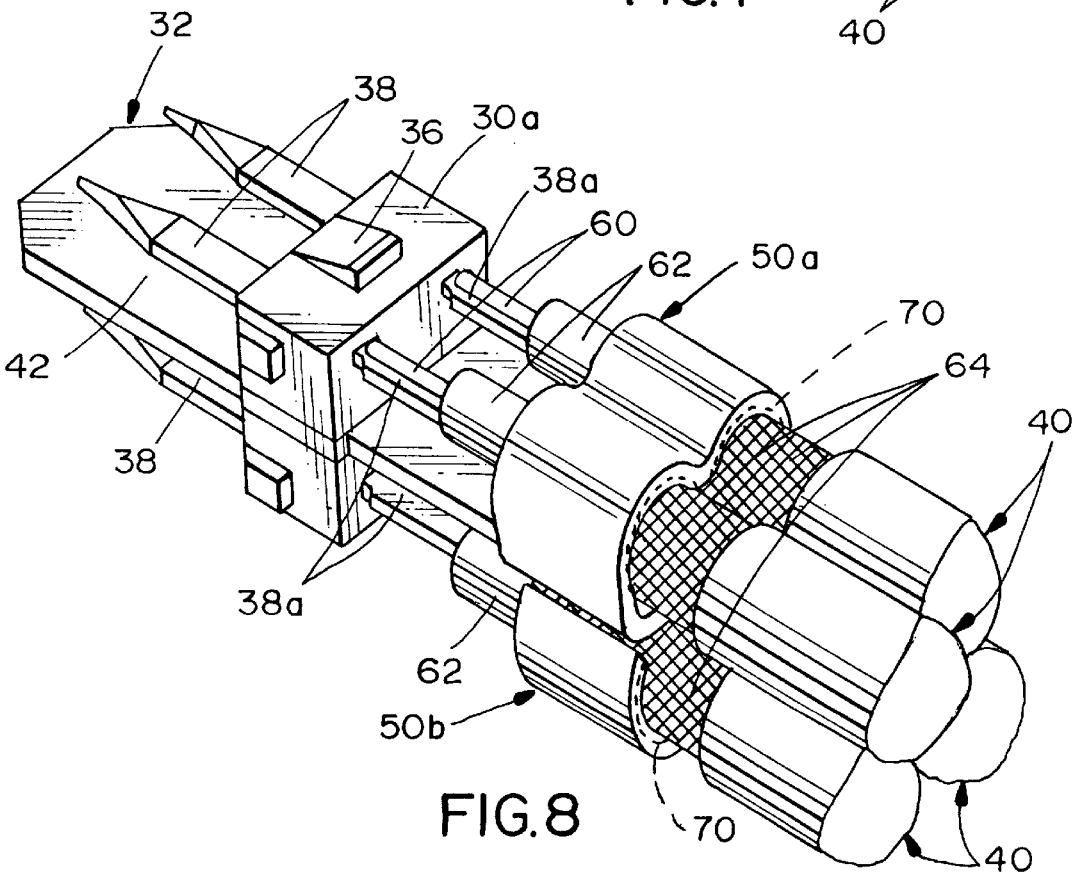
FIG. 8 is a view similar to that of FIG. 7, but showing an alternative embodiment of the invention wherein the solder material is inlayed on the inside of the gripping arms.

FIG. 8 shows an alternative embodiment of the invention wherein slots 48 have been eliminated and solder material is deposited or inlayed on the inside of gripping arms 50*a* and 50*b* as indicated by dotted lines 70 and subsequently reflowed during the soldering process. Once the gripping arms are formed as shown in FIG. 8, the inlayed solder material is not visible from the outside of the structure. During processing, after the coaxial cables are inserted into position within the gripping arms, and with the metallic braids in registry with the arms, the inlayed solder material is heated and reflowed to mechanically and electrically connect the gripping arms to the metallic shields of the coaxial cables.

In the alternative, it is believed that by using coaxial cables having inner dielectrics that can withstand relatively high temperatures without deformation or degradation, it may be possible to eliminate slots 48 or inlays 70 in gripping arms 50*a* and 50*b*. In such case, solder would be applied along the leading or trailing (or both) edges of the gripping arms where they contact the metallic shields.

The concepts of the invention have been shown and described herein in conjunction with terminating the metallic shields of a plurality of coaxial cables to a terminating member in the form of a ground plate. However, it should be understood that the concepts of the invention are equally applicable for terminating the metallic shields to other types of terminating members, such as individual electrical terminals themselves.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A termination assembly comprising:

a pair of cables each of which cables having an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield;

a terminal to which said metallic shields are to be terminated, said terminal being at least partially disposed in a dielectric housing of an electrical connector and having a termination portion formed of a generally planar base with opposed lateral edges; and a gripping arm projecting from one of said lateral edges to at least adjacent another of said lateral edges and configured to grip at least a portion of said exposed portion of said metallic shield of each of said cables without deformation of said inner dielectric such that said metallic shields of said cables are substantially surrounded by said gripping arm and said base, said gripping arm having a slot used in bonding said exposed portions of said metallic shields to said gripping arm.

2. The termination assembly of claim 1 wherein said slot in said gripping arm extends across a substantial portion of said gripping arm.

3. The termination assembly of claim 1 wherein said termination portion includes a generally planar base having opposed lateral edges and wherein said gripping arm extends from one of said lateral edges of said base toward the other opposite lateral edge of said base such that said gripping arm extends arcuately about said exposed portions of said metallic shields to thereby grip said exposed portions of said metallic shields.

4. The termination assembly of claim 1 wherein said gripping arm is contoured and cooperates with said base to generally form a pair of receiving areas for receiving said exposed portions of said metallic shields, each of said receiving areas being dimensioned such that said gripping arm maintains said cable relative to said base by gripping said exposed portion of said metallic shield disposed therein without deformation of said inner dielectric.

5. The termination assembly of claim 4 wherein said gripping arm is undulated to define generally semi-cylindrical receiving areas for respectively embracing said exposed portions of said metallic shields of said cables.

6. The termination assembly of claim 2 wherein said exposed portions of said metallic shields are bonded to said gripping arm by soldering said exposed portions to said gripping arm by using said slot in said gripping arm.

7. A termination assembly comprising:

a pair of cables each of which cables having an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield;

a terminal to which said metallic shields are to be terminated, said terminal being at least partially disposed in a dielectric housing of an electrical connector and having a termination portion;

a gripping arm projecting from said termination portion and configured to grip at least a portion of said exposed portion of said metallic shield of each of said cables without deformation of said inner dielectric, said gripping arm having a slot used in bonding said exposed portions of said metallic shields to said gripping arm; and at least one additional cable terminated to said termination portion, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and said termination assembly further including an additional gripping arm projecting from said termination portion, said additional gripping arm being configured to be disposed about said additional exposed portion of said additional metallic shield of said additional cable and configured to grip a portion of said additional metallic shield of said additional cable without deformation of said additional inner dielectric of said additional cable, said additional gripping arm having an additional slot used in bonding said additional exposed portion of said additional metallic shield to said termination portion.

8. The termination assembly of claim 7 wherein said gripping arm is spaced longitudinally on said termination portion from said additional gripping arm.

9. The termination assembly of claim 8 wherein said termination portion includes a generally planar base and wherein said slot extends along a substantial portion of said gripping arm and wherein said additional slot extends along a substantial portion of said additional gripping arm.

10. The termination assembly of claim 9 wherein said exposed portions of said metallic shields are bonded to said gripping arm by using said slot to solder said exposed portions to said gripping arm and wherein said additional exposed portion of said additional metallic shield is bonded to said additional gripping arm by using said additional slot to solder said additional exposed portion to said additional gripping arm.

11. The termination assembly of claim 8 wherein said termination portion has opposed edges and opposite sides and wherein said additional gripping arm extends from an opposite side of said termination portion from the side from which said gripping arm extends and from an edge of said termination portion opposite to the edge of said termination portion from which said gripping arm extends.

12. An electrical connector for termination to a pair of cables each of which includes an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield, said electrical connector comprising:

a dielectric housing having a mating face, a termination face and a plurality of terminal receiving passages between said mating face and said termination face;

a plurality of terminals extending through at least some of said terminal receiving passages;

a ground member disposed at least partially within said housing relative to said terminals, said ground member including a generally planar base with opposed lateral edges to which said metallic shield of said cables is to be terminated and including a gripping arm projecting from one of said lateral edges to at least adjacent another of said lateral edges and configured to grip at least a portion of said exposed portions of said metallic shield of each of said cables without deformation of said inner dielectric such that said metallic shields of said cables are substantially surrounded by said gripping arm and said base, said gripping arm having a slot used in bonding said exposed portions of said metallic shields to said base.

13. The electrical connector of claim 12 wherein said slot in said gripping arm extends across a substantial portion of said gripping arm.

14. The electrical connector of claim 12 wherein said gripping arm extends arcuately about said exposed portions of said metallic shields to thereby grip said exposed portions of said metallic shields.

15. The electrical connector of claim 14 wherein said gripping arm is contoured and cooperates with said base to generally form a pair of receiving areas for receiving said exposed portions of said metallic shields, each of said receiving areas being dimensioned such that said gripping arm maintains said cable relative to said base by gripping said exposed portion of said metallic shield disposed therein.

16. The electrical connector of claim 15 wherein said gripping arm is undulated to define generally semi-cylindrical receiving areas for respectively embracing said exposed portions of said metallic shields of said cables.

17. The electrical connector of claim 12 wherein said exposed portions of said metallic shields are bonded to said gripping arm by using said slot to solder said exposed portions to said gripping arm.

18. An electrical connector for termination to a pair of cables each of which includes an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield, said electrical connector comprising:

a dielectric housing having a mating face, a termination face and a plurality of terminal receiving passages between said mating face and said termination face;

a plurality of terminals extending through at least some of said terminal receiving passages;

a ground member disposed at least partially within said housing relative to said terminals, said ground member including a termination portion for terminating said metallic shield of said cables to said ground member, said termination portion including a gripping arm protecting from said termination portion and configured to grip at least a portion of said exposed portions of said metallic shield of each of said cables without deformation of said inner dielectric, said gripping arm having a slot used in bonding said exposed portions of said metallic shields to said termination portion; and at least one additional cable to be terminated to said termination portion, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and said electrical connector further including an additional gripping arm projecting from said termination portion, said additional gripping arm being configured to be disposed about said additional exposed portion of said additional metallic shield of said additional cable and configured to grip at least a portion of said additional exposed portion of said additional metallic shield of said additional cable without deformation of said inner dielectric, said additional gripping arm having an additional slot used in bonding said additional gripping arm to said additional exposed portion of said additional metallic shield.

19. The electrical connector of claim 18 wherein said gripping arm is spaced longitudinally on said termination portion from said additional gripping arm.

20. The electrical connector of claim 18 wherein said exposed portions of said metallic shields are bonded to said gripping arm by using said slot to solder said exposed portions to said gripping arm and wherein said additional exposed portion of said additional metallic shield is bonded to said additional gripping arm by using said additional slot to solder said additional exposed portion to said additional gripping arm.

21. The electrical connector of claim 18 wherein said termination portion has opposed edges and opposite sides and wherein said additional gripping arm extends from an opposite side of said termination portion from the side from which said gripping arm extends and from an edge of said termination portion opposite to the edge of said termination portion from which said gripping arm extends.

* * * * *